US005133200A

United States Patent [19]

Tanaka et al.

[11] Patent Number: 5,133,200

[45] Date of Patent: Jul. 28, 1992

[54] WASHING MACHINE

[75] Inventors: Tetsukazu Tanaka, Nagoya; Daisuke Naka, Kasugai, both of Japan

[73] Assignee: Kabushiki Kaisha Toshiba, Kanagawa, Japan

[21] Appl. No.: 748,658

[22] Filed: Aug. 22, 1991

[30] Foreign Application Priority Data

Aug. 27, 1990 [JP] Japan ..... 2-226070
Dec. 17, 1990 [JP] Japan ..... 2-411458

[51] Int. Cl.[5] ..... D06F 33/02
[52] U.S. Cl. ..... 68/12.03; 68/12.14
[58] Field of Search ..... 68/12.03, 12.14, 12.21

[56] References Cited

U.S. PATENT DOCUMENTS 2,985,177 5/1961 Gilson ..... 68/12.03 X
4,765,160 8/1988 Yamamoto et al. ..... 68/12.03

FOREIGN PATENT DOCUMENTS 0196995 9/1986 Japan ..... 68/12.03
0192196 8/1987 Japan ..... 68/12.03

*Primary Examiner*—Philip R. Coe
*Attorney, Agent, or Firm*—Philip M. Shaw, Jr.

[57] ABSTRACT

A washing machine automatically executing steps of wash, rinse and dehydration includes a temperature sensor sensing the temperature of water contained in a rotatable tub so that a washing operation can be performed in accordance with the water temperature and the atmospheric temperature. The wash step control data including a wash period and intensity of the water stream is determined based on the water temperature sensed by the temperature sensor during the wash step. The dehydration step control data including a dehydrating period or the rotational speed of the tub is determined based on the water temperature sensed by the temperature sensor during the rinse step.

9 Claims, 7 Drawing Sheets

WASHING MACHINE

BACKGROUND OF THE INVENTION

This invention generally relates to a fully automatic washing machine automatically executing steps of wash, rinse and dehydration sequentially, and more particularly to such a washing machine capable of executing the wash and dehydration steps in accordance with the temperature of water contained in a water-receiving tub and the atmospheric temperature.

Fully automatic washing machines have been generally provided with a temperature sensor sensing the temperature of water contained in a water-receiving tub since the degree of cleaning of clothes differs depending upon the water temperature. A wash period is determined based on the water temperature sensed by the temperature sensor at an initial stage of a wash step or after completion of the water supply into the tub.

It is desirable that a dehydration period should be determined in accordance with the atmospheric temperature since the dryness of the washed clothes differs depending upon the atmospheric temperature or seasons. However, the number of parts is increased when a sensor for sensing the atmospheric temperature is provided in addition to the above-mentioned temperature sensor Further, the data processing is complicated, resulting in the increase in the production cost. Alternatively, when the dehydration period is determined based on the water temperature sensed by the temperature sensor at the initial stage of the wash step so that the atmospheric temperature sensor is eliminated, the determined dehydration period is too short where warm water such as so-called leftover water having been used in a Japanese style bath is reused in the wash step. Consequently, a desired dehydration cannot be performed.

SUMMARY OF THE INVENTION

Therefore, an object of the present invention is to provide a washing machine which can provide a desired operation in accordance with the water temperature and the atmospheric temperature (season) with simplified data processing and without increasing the number of parts.

The present invention provides a washing machine automatically executing steps of wash, rinse and dehydration, comprising a tub rotatably mounted for containing clothes to be washed, an agitator mounted on the bottom of the tub for agitating the clothes in the wash and rinse steps, a motor for driving the tub in the dehydration step for dehydrating the clothes, a temperature sensor sensing the temperature of water contained in the tub, and control means for controlling the dehydration step based on the temperature sensed by the temperature sensor in the rinse step.

In accordance with the above-described washing machine, the rinse step is automatically executed after completion of the wash step. The control data (including the dehydration period or rotational speed of the tub for the dehydrating operation) for the dehydration step is determined based on the water temperature sensed by the temperature sensor in the rinse step. The reason for such a determination is that not the warm water but the water directly fed from the water supply system is usually used in the rinse step. Since it is considered that the temperature of the water supplied from the water supply system reflects the atmospheric temperature and accordingly, the atmospheric temperature or the season is estimated from the water temperature sensed in the rinse step so that a desired control of the dehydration operation is provided in accordance with the estimated atmospheric temperature or season. More specifically, the dehydration period is decreased as the water temperature sensed by the temperature sensor in the rinse step is raised. Further, a predetermined period is added to or subtracted from a reference period in accordance with the water temperature sensed by the temperature sensor. Consequently, an amount of input data is not increased.

The wash step may be controlled based on the water temperature sensed by the temperature sensor in the wash step. Consequently, the desired wash step can be executed in accordance with the sensed water temperature even when the warm water such as the leftover water having been used in the bath is reused or the water from the water supply system is used in the wash step. The wash period may be decreased as the water temperature sensed by the temperature sensor is raised Further, the washing operation may be controlled so tat the first dehydration is performed after completion of the wash step and thereafter, a predetermined number of the rinse and dehydration operations may be sequentially executed. The first dehydration may be controlled based on the water temperature sensed by the temperature sensor in the wash step. Since the rinse is not performed before the first dehydration, only the first dehydration operation is controlled based on the temperature of the wash liquid.

When the invention is applied to a washing machine of the type wherein the rotatable tub is mounted in a water-receiving tub, the temperature sensor may be mounted on the underside of the water-receiving tub. In this case the temperature sensor may be covered by a cover so as to be substantially air-tight. The temperature sensed by the temperature sensor is not almost influenced by an outdoor temperature and accordingly, the temperature sensing accuracy can be improved Additionally, a thermally conductive member may be interposed between the temperature sensor and the water-receiving tub. Heat transmission from the water-receiving tub to the temperature sensor can be improved.

Other objects of the present invention will become obvious upon understanding of the illustrative embodiments about to be described or will be indicated in the appended claims. Various advantages not referred to herein will occur to one skilled in the art upon employment of the invention in practice.

BRIEF DESCRIPTION OF THE DRAWINGS

The invention will be described, merely by way of example, with reference to the accompanying drawings in which.

DESCRIPTION OF THE PREFERRED EMBODIMENTS

Figure 2:
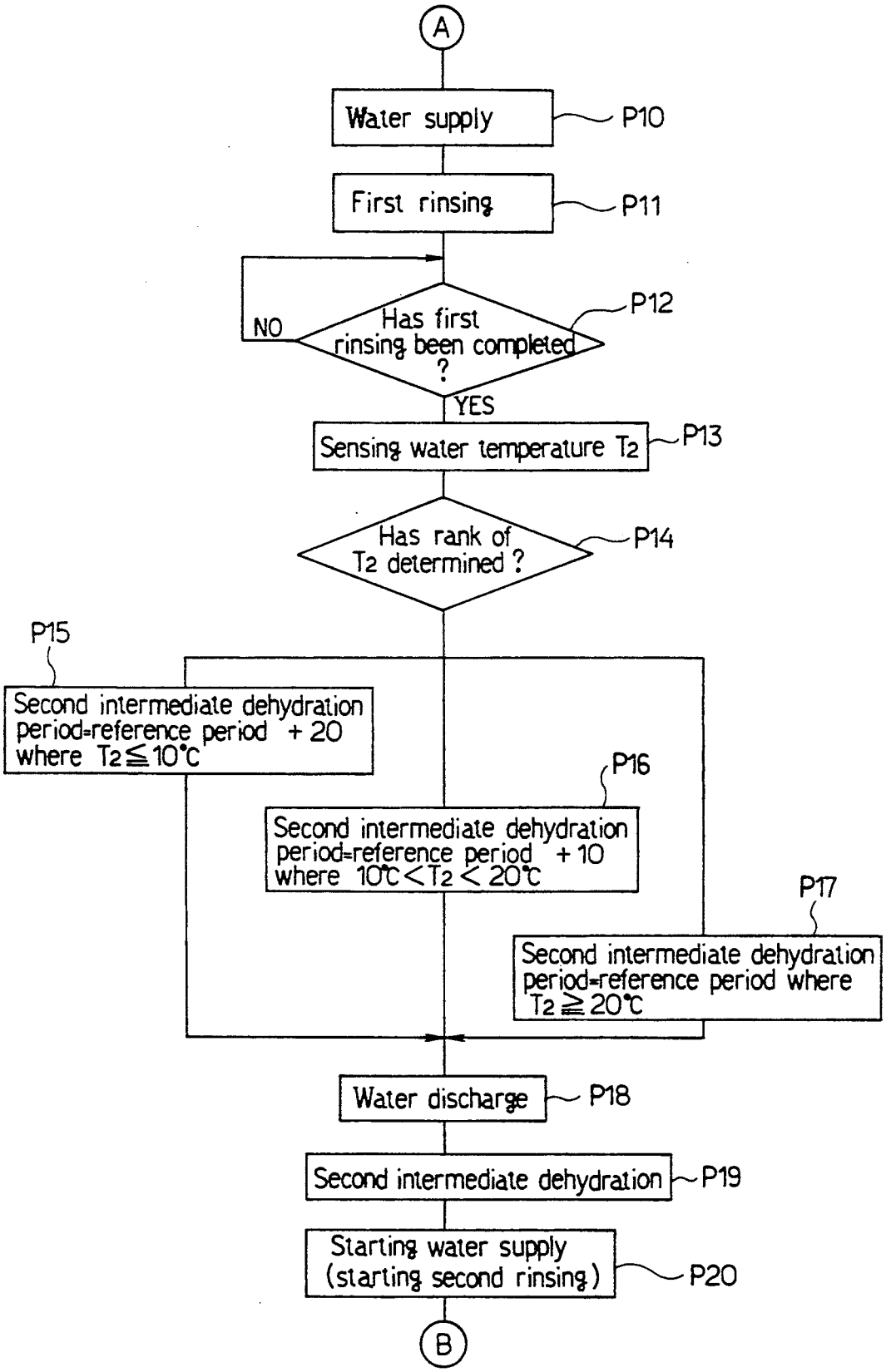
FIG. 2 is also a flowchart showing a control program for the fully automatic course in another operation mode.
Figure 3:
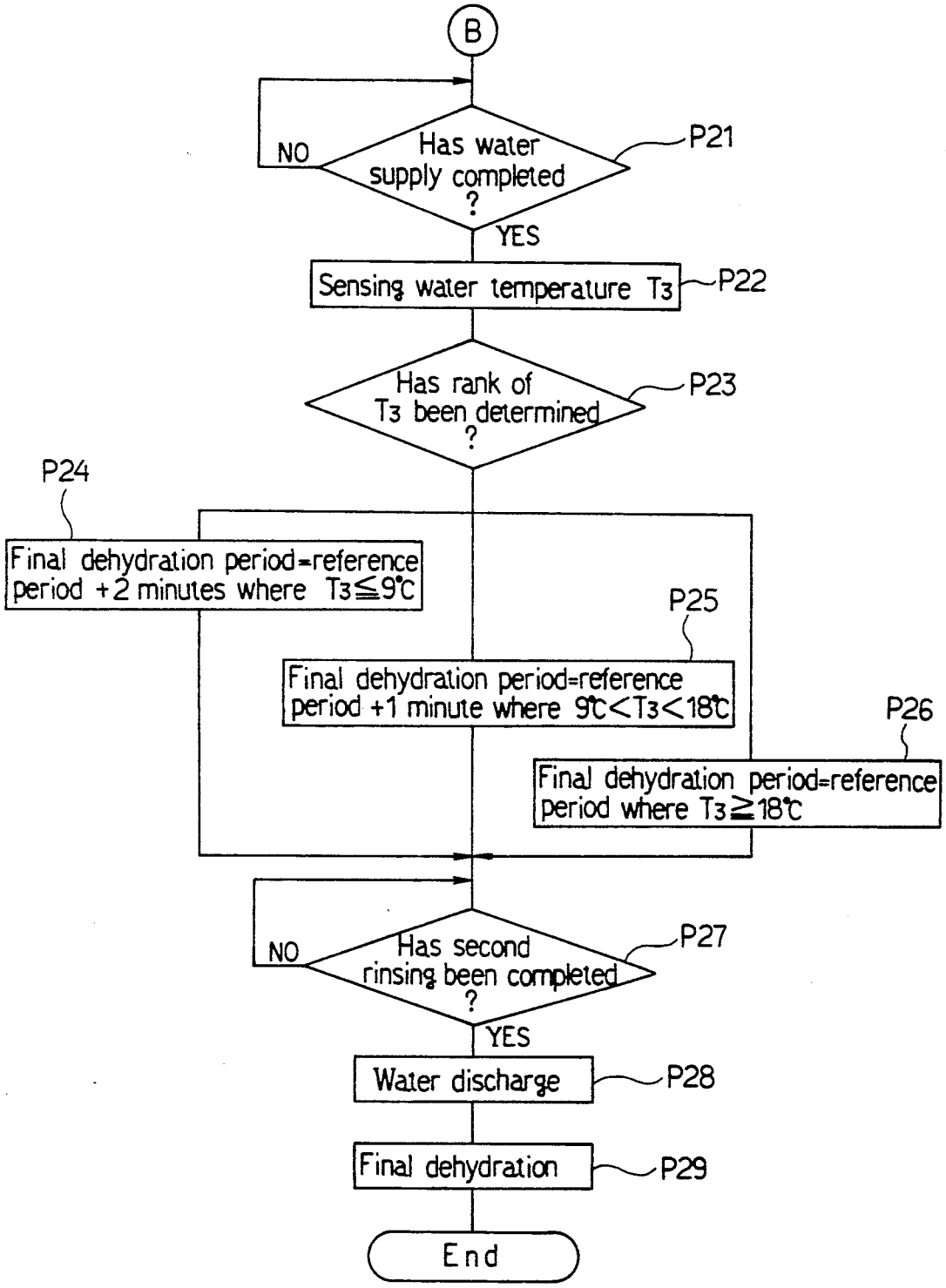
FIG. 3 is also a flowchart showing a control program for the fully automatic course in further another mode.
Figure 4:
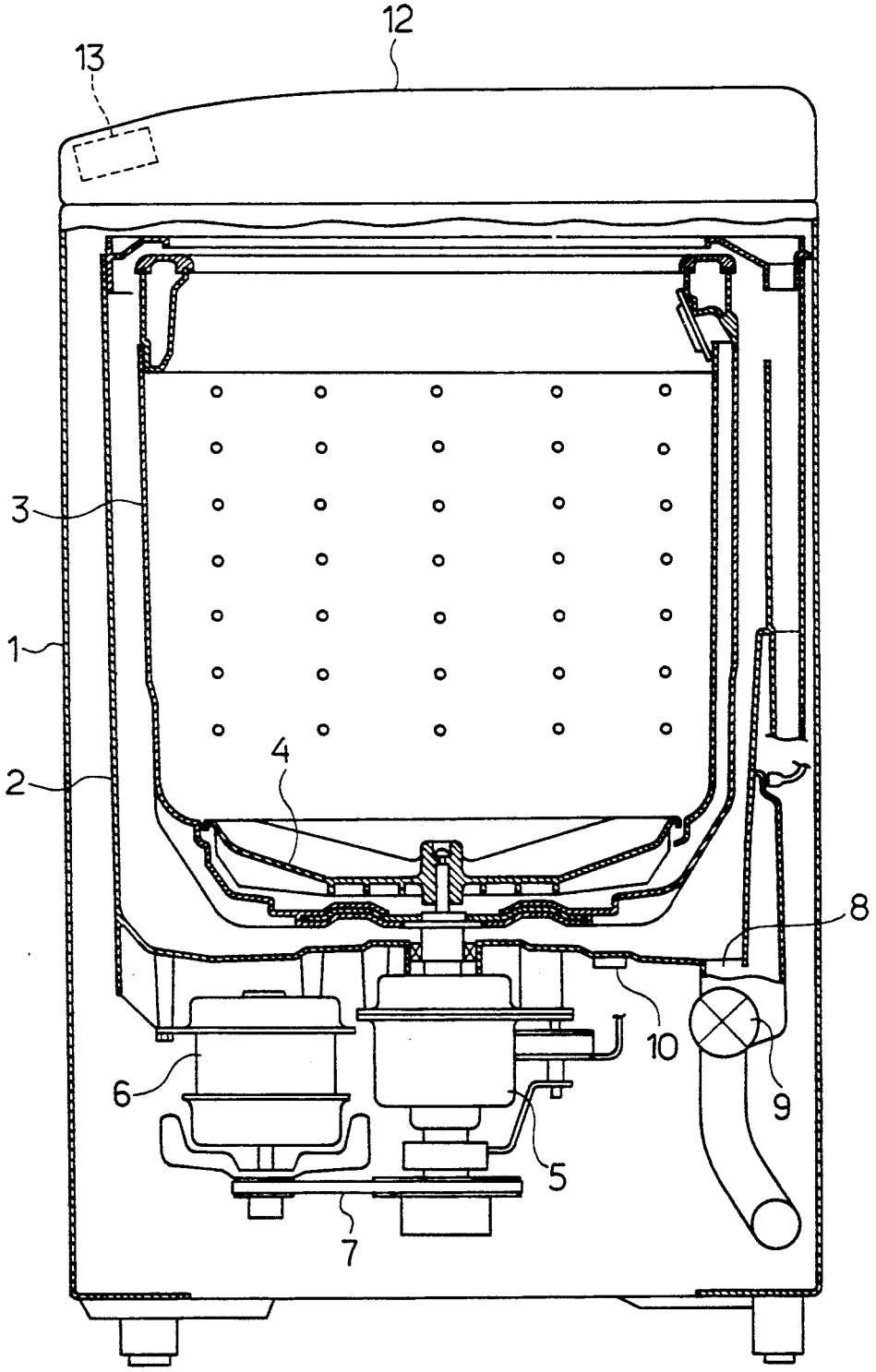
FIG. 4 is a longitudinal sectional view of the washing machine.

The fully automatic washing machine of a first embodiment will be described with reference to FIGS. 1 to 6 of the accompanying drawings. Referring first to FIG. 4, a water-receiving tub 2 is held by an elastic suspension mechanism (not shown) in an outer cabinet 1. A perforated rotatable tub 3 is rotatably mounted in the water-receiving tub 2. An agitator 4 is rotatably mounted on the bottom of the rotatable tub 3. A drive mechanism 5 and an electric motor 6 are provided on the underside of the water-receiving tub 2 for selectively driving the rotatable tub 3 or the agitator 4. Rotation of the motor 6 is transmitted to the drive mechanism 5 through a belt transmission mechanism 7. A drain hole 8 is formed in the bottom of the water-receiving tub 2. A drain valve 9 is provided for closing and opening the drain hole 8.

Figure 1:
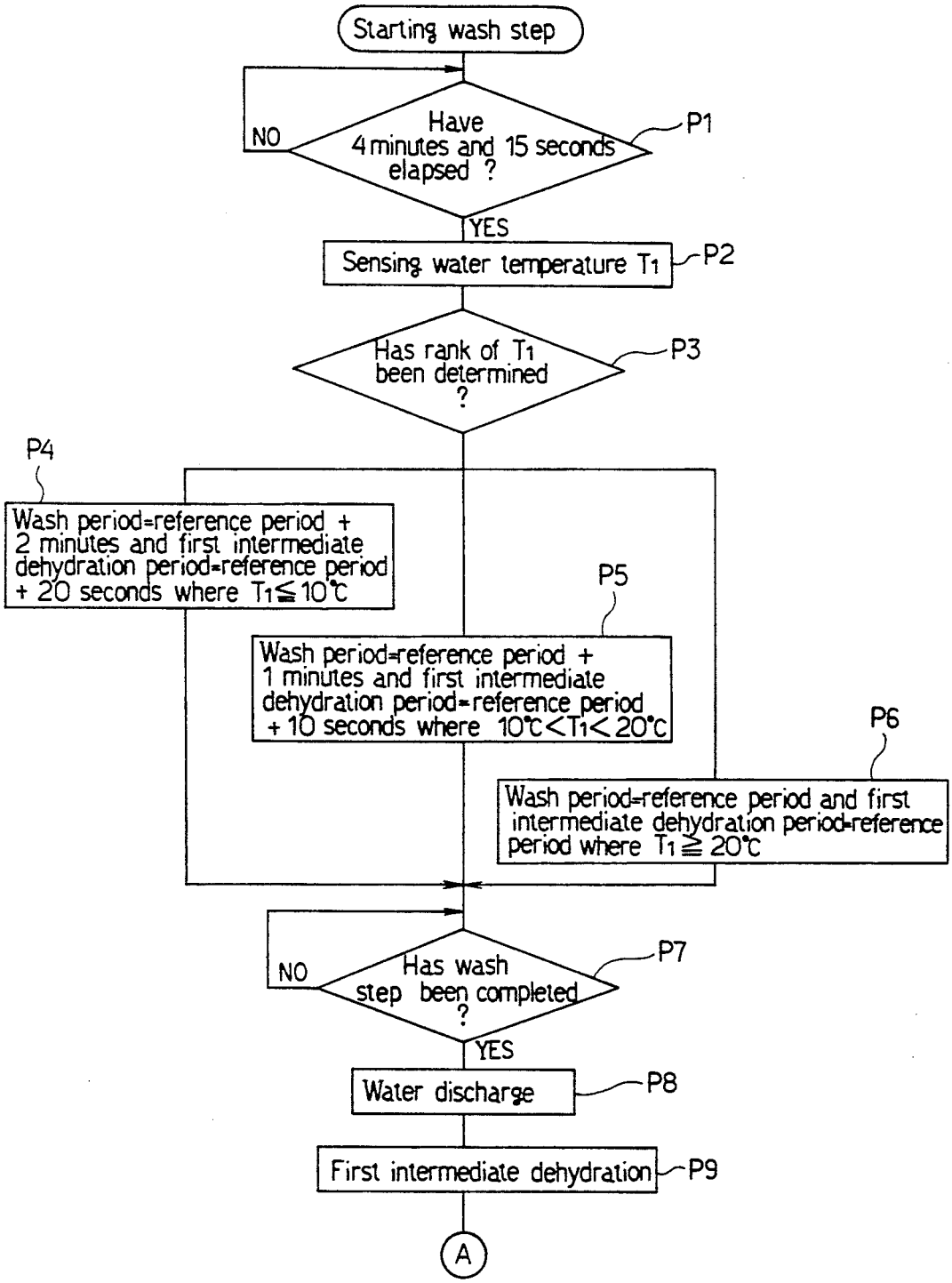
FIG. 1 is a flowchart showing a control program for a fully automatic course incorporated in the washing machine of a first embodiment in accordance with the present invention.
Figure 5:
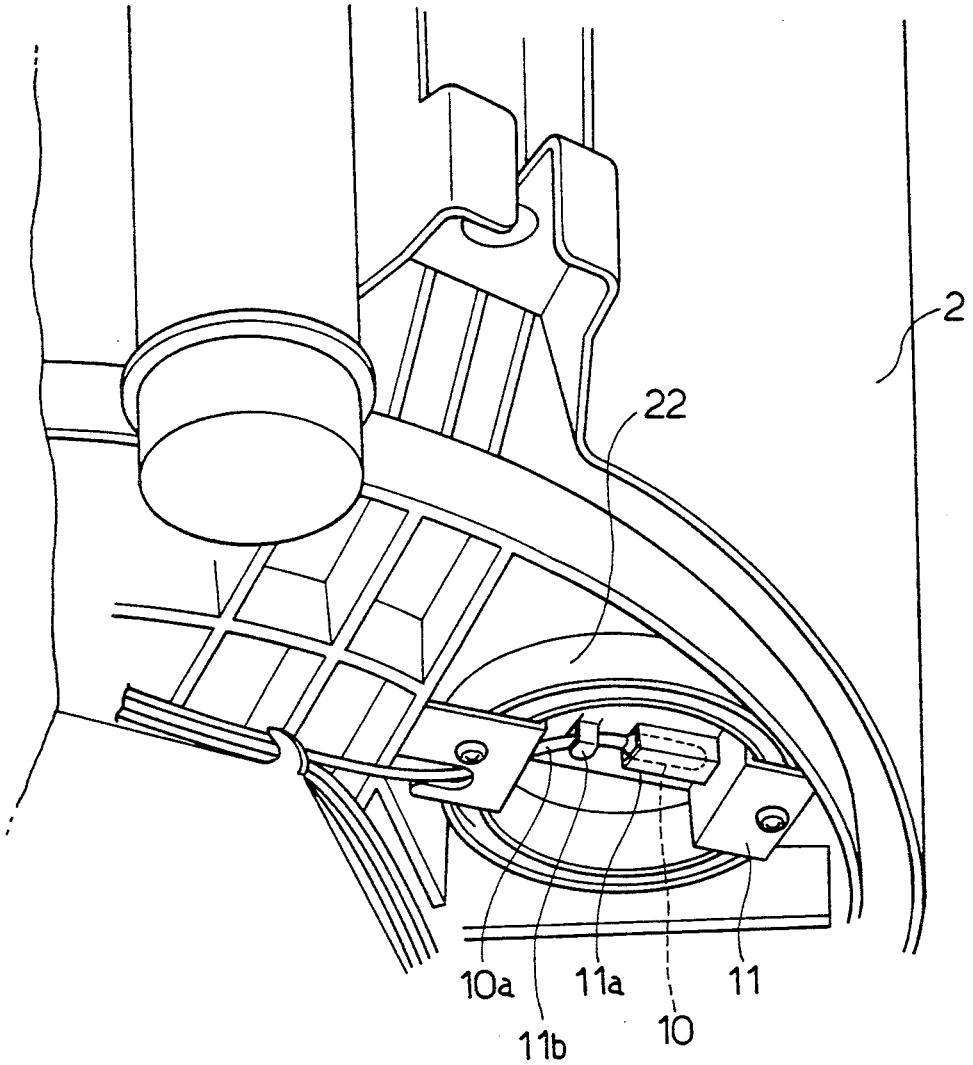
FIG. 5 is a perspective view showing the mounting structure of a temperature sensor employed in the washing machine.
Figure 6:
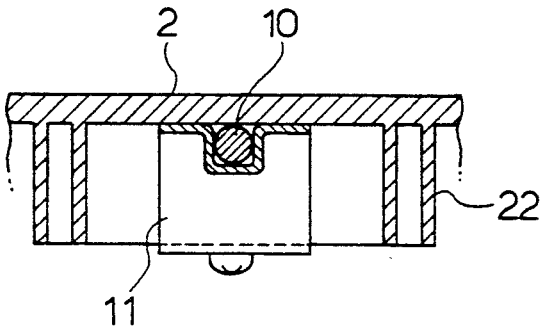
FIG. 6 is a sectional view showing the mounting structure of the temperature sensor.
Figure 7:
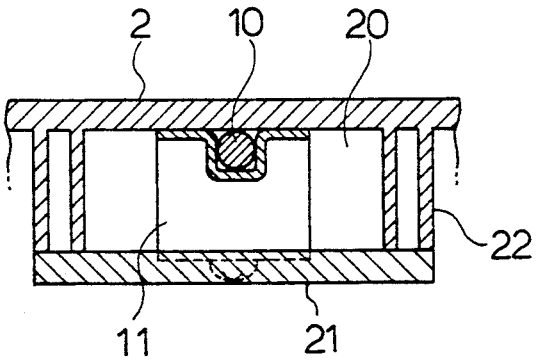
FIG. 7 is a view similar to FIG. 6 showing the mounting structure of the temperature sensor in the washing machine of a second embodiment.

Referring to FIGS. 5 and 6, a temperature sensor 10 comprising a thermistor or the like is secured on the underside of the water-receiving tub 2 so as to be closely contact therewith. The temperature sensor 10 is enclosed in a sensor enclosure 11*a* formed on a metal mounting plate 11. In this condition, the mounting plate 11 is secured to the underside of the water-receiving tub 2 by a screw so that the temperature sensor 10 is closely contact with the underside of the water-receiving tub 2 for sensing the temperature of water contained in the tub 2 via a bottom wall thereof. A lead wire 10*a* of the temperature sensor 10 is hooked by a hook 11*a* formed by cutting and raising a part of the mounting plate 11. A temperature signal generated by the temperature sensor 10 is delivered via the lead wire 10*a* to a control device 13 provided as control means in a top cover 1 2 (FIG. 4). A microcomputer (not shown) is incorporated in the control device 13 for controlling a washing operation in accordance with key input by operation keys (not shown) When a fully automatic course wherein the wash, rinse and dehydration steps are automatically executed sequentially is selected, the washing operation is controlled in accordance with control programs stored in the microcomputer as shown in FIGS. 1 to 3, as will be described hereinafter.

The water temperature $T_1$ is sensed by the temperature sensor 10 four minutes and fifteen seconds after the start of the wash step after completion of the water supply, for example (steps P1 and P2). It is determined at step P3 which of ranks $T_1 \leqq 10°$ C., $10° \text{ C.} < T_1 < 20°$ C. and $T_1 \geqq 20°$ C. the sensed temperature $T_1$ belongs to. Where it is determined that $T_1 \leqq 10°$ C., a wash period is obtained by adding two minutes to a reference period and a period of a first intermediate dehydration performed at the final stage of the wash step is obtained by adding twenty seconds to a reference period (step S4). Where it is determined that $10° \text{ C.} < T_1 < 20°$ C., the wash period is obtained by adding one minute to the reference period and the first intermediate dehydration period is obtained by adding ten seconds to the reference period (step P5). Where it is determined that $T_1 \geqq 20°$ C., the wash period and the first intermediate dehydration period are determined to correspond to the respective reference periods (step P6).

The motor 6 is deenergized at the time the wash period determined based on the sensed water temperature $T_1$ elapses. The drain valve 9 is energized to open the drain hole 8 so that the wash liquid in the water-receiving tub 2 is discharged therefrom (step P8). Then, the rotatable tub 3 is rotated at a high speed for the first intermediate period determined as described above for execution of the intermediate dehydration (step P9). Thereafter, the water is resupplied to the water-receiving tub 2 (step P10) so that a first rinsing is executed (step P11). When the first rinsing is completed, the water temperature $T_2$ is sensed by the temperature sensor 10 (steps P12 and P13). It is determined at step P14 which of ranks $T_2 \leqq 10°$ C., $10° \text{ C.} < T_2 < 20°$ C. and $T_2 \geqq 20°$ C. the sensed temperature $T_2$ belongs to. Where it is determined that $T_2 \leqq 10°$ C., a second intermediate dehydration period is obtained by adding twenty seconds to the reference period (step P15). Where it is determined that $10° \text{ C.} < T_2 < 20°$ C., the second intermediate dehydration period is obtained by adding ten seconds to the reference period (step P16). Where it is determined that $T_2 \geqq 20°$ C., the second intermediate dehydration period is determined to correspond to the reference period (step P17).

Subsequently, discharge of the wash liquid is performed (step P18) and the second intermediate dehydration is executed for the period determined as described above (step P19). The water is then supplied and a second rinsing is initiated (step P20). The water temperature $T_3$ is sensed by the temperature sensor 10 at the time the water supply is completed (steps P21 and P22). It is determined at step P23 which of ranks $T_3 \leqq 9°$ C., $9° \text{ C.} < T_3 < 18°$ C. and $T_3 \geqq 18°$ C. the sensed temperature $T_3$ belongs to. Where it is determined that $T_3 \leqq 9°$ C., a final dehydration period is obtained by adding two minutes to the reference period (step P24). Where it is determined that $9° \text{ C.} < T_3 < 18°$ C., the final dehydration period is obtained by adding one minute to the reference period (step P25). Where it is determined that $T_3 \geqq 18°$ C., the final dehydration period is to correspond to the reference period (step P26). The wash liquid is discharged (step P28) when the second rinsing is completed (step P27). The final dehydration is executed for the period determined as described above (step P29).

In accordance with the above-described embodiment, the wash step period is determined based on the water temperature sensed by the temperature sensor 10 at the initial stage of the wash step. Consequently, a desired wash period can be obtained in accordance with the water temperature whether the warm water such as the leftover water having been used in the bath is reused or the water from the water supply system is used for the washing. Further, a desired dehydration period can be determined since it is determined based on the water temperature sensed by the temperature sensor 10 in the rinse step. The reason for this is as follows: not the warm water but the water directly fed from the water supply system is usually used in the rinse step and the atmospheric temperature or the season can be estimated based on the water temperature sensed in the rinse step since the water from the water supply is considered to reflect the atmospheric temperature.

Since both of the wash and dehydration periods are determined with accuracy based on the water temperature sensed by a single temperature sensor 10, provision of a dedicated sensor for sensing the atmospheric temperature is not needed. Consequently, the number of parts can be prevented from being increased and the data processing can be readily performed, resulting in low production cost.

The water temperature $T_1$ is sensed by the temperature sensor 10 four minutes and fifteen seconds after the start of the wash step after completion of the water supply, for example, in the foregoing embodiment This sensing manner takes into consideration a period (response) necessary for the temperature of the water in the water-receiving tub 2 to be completely transferred to the temperature sensor 10 through the bottom wall of the tub 2 by way of the heat transmission. Since the period of the wash step is determined to be five minutes at the shortest, the period for sensing the water temperature is set so as to be as long as possible within the period of the wash step so that an accurate water temperature sensing can be provided. Alternatively, the water temperature may be sensed at an initial stage of the wash step immediately after completion of the water supply when the temperature sensor 10 is mounted in the water-receiving tub 2 for improvement of the response.

Further, since the temperature sensor 10 is mounted on the underside of the water-receiving tub 2 in the foregoing embodiment, a countermeasure for waterproof of the temperature sensor 10 is not needed, resulting in the low production cost.

FIG. 2 illustrates a second embodiment of the invention. An annular wall 22 is formed on the underside of the water-receiving tub 2 so as to surround the temperature sensor 10. A cover 21 formed from a heat insulation material such as cushion is secured by an adhesive to the underside of the annular wall 22 such that a space 20 in which the temperature sensor 10 is enclosed is substantially air-tight. Consequently, the water temperature sensed by the temperature sensor 10 can be prevented from being influenced by the room temperature.

Figure 8:
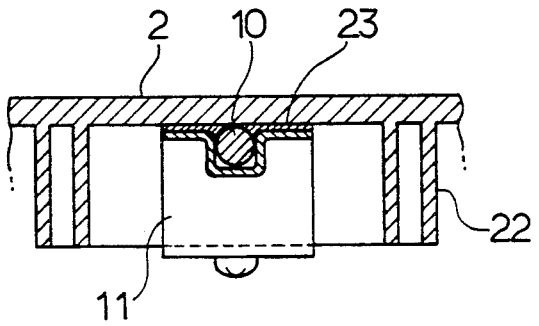
FIG. 8 is a view similar to FIG. 6 showing the mounting structure of the temperature sensor in the washing machine of a third embodiment.
Figure 9:
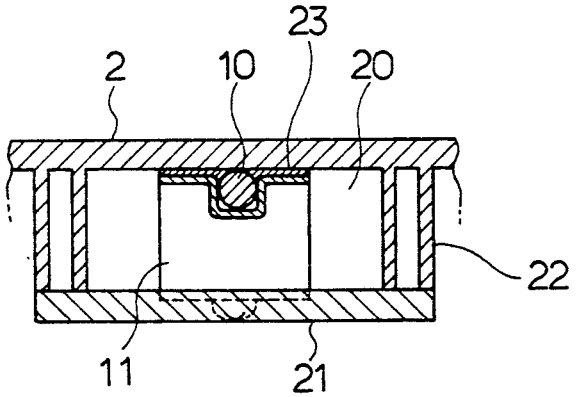
FIG. 9 is a view similar to FIG. 6 showing the mounting structure of the temperature sensor in the washing machine of a fourth embodiment.

FIGS. 8 and 9 illustrate third and fourth embodiments respectively. In order to improve the efficiency of heat transfer from the bottom of the water-receiving tub 2 to the temperature sensor 10, a semifluid thermally conductive member 23 such as silicon grease is interposed between the bottom of the water-receiving tub 2 and the temperature sensor 10.

The semifluid thermally conductive member 23 is interposed between the water-receiving tub bottom and the temperature sensor 10 without any gap. Accordingly, the temperature sensor 10 can be in close contact with the water-receiving tub bottom even when the water-receiving tub 2 has an irregular outer bottom surface or deformation of the mounting plate 11 or the like causes the temperature sensor 10 to be slightly raised or inclined. Consequently, the heat transfer from the water-receiving tub bottom to the temperature sensor 10 can be improved and the accuracy in sensing the water temperature can be improved.

The thermally conductive member 23 should not be limited to the semifluid material such as the silicon grease. It may be formed from any elastic or plastic thermally conductive solid material, instead.

In addition to the wash period, a water stream mode may be determined based on the water temperature sensed at the initial stage of the wash step. Further, the motor speed for the dehydrating operation may be determined based on the water temperature sensed in the rinse step. Additionally, the relation between the sensed water temperature and the wash and dehydration periods may be changed and the number of the rinsing operations may be changed.

The foregoing disclosure and drawings are merely illustrative of the principles of the present invention and are not to be interpreted in a limiting sense. The only limitation is to be determined from the scope of the appended claims.

We claim:

1. A washing machine automatically executing steps of wash, rinse and dehydration, comprising:

a) a tub rotatably mounted for containing clothes to be washed;

b) an agitator mounted on the bottom of the tub for agitating the clothes in the wash and rinse steps;

c) a motor for driving the tub in the dehydration step for dehydrating the clothes;

d) a temperature sensor sensing the temperature of water contained in the tub; and e) control means for controlling the dehydration step based on the temperature sensed by the temperature sensor in the rinse step.

2. A washing machine according to claim 1, wherein the control means controls the dehydration step so that a dehydration period is decreased as the temperature sensed by the temperature sensor in the rinse step is raised.

3. A washing machine according to claim 2, wherein the control means determines the dehydration step so that a predetermined period is added to or subtracted from a reference period in accordance with the temperature sensed by the temperature sensor.

4. A washing machine according to claim 1, wherein the control means controls the wash step based on the temperature sensed by the temperature sensor in the wash step.

5. A washing machine according to claim 4, wherein the control means controls the wash step so that a wash period is decreased as the temperature sensed by the temperature sensor in the wash step is raised.

6. A washing machine according to claim 1, wherein the control means controls the wash, rinse and dehydration steps such that a first dehydration operation is performed after completion of the wash step and thereafter, the rinse and dehydration operations are each executed by a predetermined number of times, the first dehydration operation being controlled based on the temperature sensed by the temperature sensor in the wash step.

7. A washing machine according to claim 1, wherein the rotatable tub is mounted in a water-receiving tub and the temperature sensor is mounted on the underside of the water-receiving tub.

8. A washing machine according to claim 7, wherein the temperature sensor is covered so as to be substantially airtight.

9. A washing machine according to claim 7, wherein a thermally conductive member is interposed between the temperature sensor and the water-receiving tub.

* * * * *